US011319130B2

(12) United States Patent
Meers

(10) Patent No.: US 11,319,130 B2
(45) Date of Patent: May 3, 2022

(54) BEVERAGE CRATE

(71) Applicant: Rehrig Pacific Company, Los Angeles, CA (US)

(72) Inventor: Ryan C. Meers, West Chester, PA (US)

(73) Assignee: Rehrig Pacific Company, Los Angeles, CA (US)

( * ) Notice: Subject to any disclaimer, the term of this patent is extended or adjusted under 35 U.S.C. 154(b) by 796 days.

(21) Appl. No.: 14/959,432

(22) Filed: Dec. 4, 2015

(65) Prior Publication Data

US 2016/0159542 A1 Jun. 9, 2016

Related U.S. Application Data

(60) Provisional application No. 62/087,622, filed on Dec. 4, 2014.

(51) Int. Cl.

| | |
|---|---|
| ***B65D 71/70*** | (2006.01) |
| ***B65D 1/24*** | (2006.01) |
| ***B65D 21/02*** | (2006.01) |

(52) U.S. Cl.

CPC ..... *B65D 71/70* (2013.01); *B65D 1/243* (2013.01); *B65D 21/0233* (2013.01); *B65D 2501/2407* (2013.01); *B65D 2501/24019* (2013.01); *B65D 2501/24114* (2013.01); *B65D 2501/24133* (2013.01); *B65D 2501/24152* (2013.01); *B65D 2501/24261* (2013.01); *B65D 2501/24267* (2013.01); *B65D 2501/24522* (2013.01); *B65D 2501/24535* (2013.01); *B65D 2501/24687* (2013.01)

(58) Field of Classification Search

USPC ..... 206/203, 427

See application file for complete search history.

(56) References Cited

U.S. PATENT DOCUMENTS

| | | | |
|---|---|---|---|
| D103,862 | S | 8/1936 | Randall et al. |
| 2,411,673 | A | 11/1946 | Vechey, Jr. |
| D147,981 | S | 11/1947 | Lehman |
| D152,907 | S | 3/1949 | Richards |
| 2,512,855 | A | 6/1950 | Erickson |

(Continued)

FOREIGN PATENT DOCUMENTS

| | | |
|---|---|---|
| AU | 705846 B2 | 11/1998 |
| BE | 680197 A2 | 10/1966 |

(Continued)

OTHER PUBLICATIONS

Photograph of Pepsi—Blue Crate, Top View.

(Continued)

*Primary Examiner* — Jacob K Ackun

(74) *Attorney, Agent, or Firm* — Carlson, Gaskey & Olds, P.C.

(57) ABSTRACT

A beverage crate includes a base, end walls at ends of the base, and side walls at sides of the base. The side walls each include a plurality of side columns extending upward from a lower portion of the side wall. The side walls are significantly shorter than the end walls to improve visibility and accessibility of containers in the crate. The side columns are significantly shorter than the lower portion of the side wall, significantly shorter than end columns and corner columns of the crate.

23 Claims, 9 Drawing Sheets

(56) References Cited

U.S. PATENT DOCUMENTS 2,526,335 A 10/1950 Deichert
2,530,481 A 11/1950 Rawn, Jr.
2,535,493 A 12/1950 Gerber
2,588,805 A 3/1952 Cross
2,626,079 A 1/1953 Keller
D172,664 S 1/1954 Emery
2,743,030 A 4/1956 Read, Jr.
2,760,676 A 8/1956 Knieriem
2,840,256 A 6/1958 Cobb, Jr.
2,928,530 A 3/1960 Sauey
2,935,222 A 5/1960 Oconnell
2,970,715 A 2/1961 Kappel
D189,891 S 3/1961 Schillin
2,974,819 A 3/1961 Melville
2,979,222 A 4/1961 Morton
3,009,579 A 11/1961 Ettlinger, Jr.
3,055,531 A 9/1962 De Chelbor
3,055,542 A 9/1962 Russo
3,092,284 A 6/1963 Stout
D195,702 S 7/1963 Russo
3,106,308 A 10/1963 Kazimier
3,151,762 A 10/1964 Vidal
3,155,268 A 11/1964 Fogerty
3,184,148 A 5/1965 Poupitch
D201,257 S 6/1965 Vidal
3,247,996 A 4/1966 Garcia
3,283,947 A 11/1966 Cornelius
3,297,190 A 1/1967 Cloyd
D208,111 S 7/1967 Vidal
3,332,574 A 7/1967 Earp
3,333,727 A 8/1967 Belcher
3,333,729 A 8/1967 Rabb
3,334,767 A 8/1967 Cornelius
3,349,943 A 10/1967 Box
D209,864 S 1/1968 Vesteeg
3,376,998 A 4/1968 Cornelius
3,384,261 A 5/1968 Austin
3,390,801 A 7/1968 Adomat
3,391,814 A 7/1968 Box
3,391,815 A 7/1968 Box
3,392,869 A 7/1968 Needt
3,416,694 A 12/1968 Bebb
3,428,207 A 2/1969 Schoeller
3,517,852 A 6/1970 Schoeller
3,628,684 A 12/1971 Sere
3,638,824 A 2/1972 Sekiguchi
3,682,351 A 8/1972 De Putter
3,701,449 A 10/1972 Schoeller
3,759,416 A 9/1973 Constantine
D229,674 S 12/1973 Quigg
3,788,002 A 1/1974 Suchka
3,812,996 A 5/1974 Bunnell
3,865,239 A 2/1975 Herolzer et al.
D239,213 S 3/1976 Carroll
3,949,876 A 4/1976 Bridges et al.
3,991,879 A 11/1976 Hirota
3,998,237 A 12/1976 Kressin et al.
3,998,328 A 12/1976 Box
RE29,262 E 6/1977 Utz
4,027,796 A 6/1977 Martin
4,037,722 A 7/1977 Bremer
4,040,517 A 8/1977 Torokvei
4,071,162 A 1/1978 Steinlein et al.
4,095,720 A 6/1978 Delbrouck et al.
4,101,049 A 7/1978 Wallace et al.
4,161,259 A 7/1979 Palafox
4,162,738 A 7/1979 Wright
4,202,448 A 5/1980 Jaeger et al.
4,204,596 A 5/1980 Davis
4,295,576 A 10/1981 Steinlein
4,308,966 A 1/1982 Ettema et al.
4,319,685 A 3/1982 David
4,343,400 A 8/1982 Faucillon
4,344,530 A 8/1982 deLarosiere
D266,709 S 10/1982 Box
D268,791 S 4/1983 Wood
4,387,824 A 6/1983 Wefers
4,410,099 A 10/1983 deLarosiere
4,416,373 A 11/1983 deLarosiere
D275,142 S 8/1984 Torokvei
4,538,742 A 9/1985 Prodel
4,548,320 A 10/1985 Box
D283,103 S 3/1986 Cushing et al.
4,585,137 A 4/1986 Poutiainen et al.
D284,841 S 7/1986 Rowland et al.
4,615,444 A 10/1986 de Larosiere
D289,938 S 5/1987 Warwick
D291,178 S 8/1987 Toms
4,700,836 A 10/1987 Hammett
4,700,837 A 10/1987 Hammett
D295,107 S 4/1988 Frost
4,773,554 A 9/1988 Warwick
4,789,063 A 12/1988 Hammett
4,846,365 A 7/1989 Steinlein
4,848,580 A 7/1989 Wise
D304,123 S 10/1989 Warwick
4,899,874 A 2/1990 Apps et al.
4,911,303 A 3/1990 Andersson
4,928,841 A 5/1990 Arthurs
4,932,532 A 6/1990 Apps et al.
4,944,400 A 7/1990 Van Onstein et al.
4,978,000 A 12/1990 Mohr
4,978,002 A 12/1990 Apps et al.
D313,493 S 1/1991 Apps et al.
5,009,053 A 4/1991 Langenbeck et al.
D317,670 S 6/1991 Apps
D318,552 S 6/1991 Apps
5,031,749 A 7/1991 McCoy
5,031,774 A 7/1991 Morris et al.
5,035,326 A * 7/1991 Stahl ..... B65D 21/041 206/505
D319,129 S 8/1991 Apps et al.
5,040,681 A 8/1991 Grusin
D320,298 S 9/1991 Apps et al.
5,060,819 A 10/1991 Apps
5,071,026 A 12/1991 Apps
5,078,282 A 1/1992 Stanfield
5,096,085 A 3/1992 Eek et al.
D325,279 S 4/1992 Apps
5,105,948 A 4/1992 Morris et al.
D326,749 S 6/1992 Apps et al.
D327,357 S 6/1992 Rehrig
D327,972 S 7/1992 Apps et al.
D329,931 S 9/1992 Apps
D329,932 S 9/1992 Apps
5,184,748 A 2/1993 Apps
5,213,211 A * 5/1993 Umiker ..... B65D 71/70 206/392
5,267,649 A 12/1993 Apps et al.
5,287,966 A * 2/1994 Stahl ..... B65D 21/041 206/503
5,305,884 A 4/1994 Apps et al.
5,316,172 A 5/1994 Apps et al.
5,320,245 A 6/1994 Apps et al.
5,335,814 A 8/1994 Hepp
D350,438 S 9/1994 Apps et al.
5,351,814 A 10/1994 Apps
5,377,862 A 1/1995 Oakes et al.
D356,679 S 3/1995 Apps et al.
5,405,042 A 4/1995 Apps et al.
5,419,451 A 5/1995 Bitel, Jr.
5,421,477 A 6/1995 Hammett
D360,758 S 8/1995 Umiker
D361,431 S 8/1995 Koefelda
5,465,843 A * 11/1995 Koefelda ..... B65D 21/04 206/505
5,487,487 A 1/1996 Hammett
5,495,945 A 3/1996 Apps et al.
5,501,352 A * 3/1996 Apps ..... B65D 1/243 206/144
5,529,176 A 6/1996 Apps et al.
5,575,390 A 11/1996 Apps et al.
D378,249 S 3/1997 Apps et al.
D379,121 S 5/1997 Apps et al.

(56) References Cited

U.S. PATENT DOCUMENTS

D379,717 S 6/1997 Apps et al.
D380,613 S 7/1997 Apps et al.
D380,901 S 7/1997 Apps et al.
5,651,461 A 7/1997 Apps et al.
5,660,279 A 8/1997 Apps et al.
5,669,498 A 9/1997 Fierek et al.
5,702,022 A 12/1997 Umiker
5,704,482 A 1/1998 Apps et al.
5,740,934 A 4/1998 Brady
5,769,230 A 6/1998 Koefelda
D395,954 S 7/1998 Apps et al.
5,785,170 A 7/1998 Hammett
D398,152 S 9/1998 Kelly
D399,060 S 10/1998 Apps et al.
D400,012 S 10/1998 Apps
5,823,376 A 10/1998 McGrath
D401,764 S 12/1998 Apps et al.
5,842,572 A 12/1998 Apps et al.
D404,204 S 1/1999 Apps
5,855,277 A * 1/1999 Apps ..... B65D 21/04 206/203
5,881,902 A * 3/1999 Ackermann ..... B65D 21/041 206/507
5,896,992 A * 4/1999 McGrath ..... B65D 21/045 206/505
D410,778 S 6/1999 Apps et al.
D412,399 S 8/1999 Apps et al.
5,964,343 A 10/1999 Steiner
5,971,204 A 10/1999 Apps
5,979,654 A 11/1999 Apps
D417,784 S 12/1999 Umiker
6,006,912 A 12/1999 McGrath
6,047,844 A 4/2000 McGrath
6,059,109 A 5/2000 Stein
6,073,793 A * 6/2000 Apps ..... B65D 1/243 206/203
6,079,554 A 6/2000 Hammett et al.
6,112,938 A 9/2000 Apps
6,131,730 A 10/2000 Hsu
D420,220 S 12/2000 Apps et al.
6,186,328 B1 2/2001 Apps
6,189,734 B1 2/2001 Apps et al.
6,237,758 B1 5/2001 Hsu
D446,015 S 8/2001 Apps
6,401,960 B1 * 6/2002 Hammett ..... B65D 1/243 206/203
D461,957 S 8/2002 Hammett
D462,522 S 9/2002 Apps et al.
6,454,120 B1 * 9/2002 Hammett ..... B65D 1/243 206/203
6,457,599 B1 10/2002 Apps et al.
D465,417 S 11/2002 Apps
D466,018 S 11/2002 Apps
D468,634 S 1/2003 Hammett
6,557,718 B1 * 5/2003 Cesano ..... B65D 21/045 220/505
D483,946 S 12/2003 Koefelda
D485,756 S 1/2004 Apps
D487,634 S 3/2004 Apps et al.
6,749,065 B1 6/2004 Hammett
D494,867 S 8/2004 Apps
6,851,563 B1 2/2005 Lipari
D505,014 S 5/2005 Apps et al.
6,886,710 B2 * 5/2005 Verna ..... B65D 21/045 220/505
6,892,885 B2 5/2005 Apps et al.
6,899,247 B1 5/2005 Koefelda et al.
D507,880 S 8/2005 Hassell et al.
6,966,442 B2 11/2005 Hassell et al.
7,011,215 B2 3/2006 Meissen et al.
7,017,746 B2 3/2006 Apps
7,036,666 B2 * 5/2006 Hammett ..... B65D 21/0213 206/503
7,086,531 B2 8/2006 Apps et al.
7,093,715 B1 8/2006 Apps
7,097,033 B2 8/2006 Koefelda et al.
7,128,234 B2 10/2006 Apps et al.
7,207,458 B1 4/2007 Koefelda et al.
7,252,196 B1 8/2007 Koefelda et al.
7,281,641 B2 10/2007 Apps
7,311,217 B2 12/2007 Apps
7,322,475 B2 1/2008 Hassell et al.
7,322,486 B2 1/2008 Koefelda et al.
7,549,539 B2 6/2009 Apps
7,604,122 B2 10/2009 Apps et al.
7,658,278 B2 2/2010 Apps et al.
7,677,405 B2 3/2010 Apps et al.
7,694,839 B2 4/2010 Koefelda et al.
D615,758 S 5/2010 Lindstrom
7,735,676 B2 6/2010 Ogburn
7,743,939 B2 6/2010 Stahl
7,950,521 B2 5/2011 Apps
8,056,753 B2 * 11/2011 Koefelda ..... B65D 1/22 206/519
8,109,408 B2 2/2012 Hassell
8,123,034 B2 2/2012 Apps et al.
8,200,445 B2 6/2012 Kashiwakura
8,672,161 B2 * 3/2014 Apps ..... B65D 1/22 206/509
8,720,688 B2 5/2014 Hassell et al.
9,010,536 B2 * 4/2015 McCanless ..... B65D 21/0233 206/564
2001/0015329 A1 8/2001 Apps et al.
2001/0019063 A1 * 9/2001 Apps ..... B65D 1/22 220/771
2002/0148837 A1 10/2002 Apps
2002/0195452 A1 12/2002 Apps
2003/0024844 A1 2/2003 Hammett
2003/0029870 A1 2/2003 Apps et al.
2003/0057211 A1 3/2003 Koefelda et al.
2003/0075546 A1 4/2003 Hammett
2005/0017063 A1 1/2005 Noone et al.
2005/0067314 A1 3/2005 Koefelda et al.
2005/0072710 A1 4/2005 Hammett et al.
2005/0279651 A1 * 12/2005 Perret ..... B65D 71/70 206/203
2006/0169620 A1 8/2006 Apps
2007/0187276 A1 * 8/2007 Stahl ..... B65D 21/0233 206/505
2007/0246392 A1 10/2007 Stahl
2008/0067097 A1 * 3/2008 Apps ..... B65D 1/243 206/505
2008/0116214 A1 5/2008 Apps et al.
2009/0206088 A1 8/2009 Ogburn
2009/0242568 A1 10/2009 Apps
2010/0084297 A1 4/2010 Apps
2010/0084302 A1 4/2010 Apps
2010/0147642 A1 6/2010 Andochick
2010/0170823 A1 7/2010 Koefelda et al.
2010/0258467 A1 10/2010 Apps
2011/0056861 A1 3/2011 Apps
2011/0240659 A1 10/2011 Orgeldinger
2012/0152789 A1 6/2012 Apps et al.
2013/0213855 A1 * 8/2013 Orgeldinger ..... B65D 1/243 206/765
2015/0014200 A1 * 1/2015 Apps ..... B65D 71/70 206/427

FOREIGN PATENT DOCUMENTS

BE 693216 A 7/1967
CA 965056 A1 3/1975
CA 1109433 A1 9/1981
DE 1207268 B 12/1965
DE 2837910 A1 3/1980
DE 102007050061 A1 12/2008
EP 99827 A1 2/1984
EP 210712 A2 2/1987
EP 464894 B1 8/1994
EP 915021 A1 5/1999
EP 1008527 A1 6/2000
EP 1124730 A1 8/2001

(56) References Cited

FOREIGN PATENT DOCUMENTS

| | | | |
|---|---|---|---|
| EP | 2090516 | A1 | 8/2009 |
| EP | 2107006 | A1 | 10/2009 |
| FR | 1285689 | A | 2/1962 |
| FR | 1350962 | A | 1/1964 |
| FR | 1351218 | A | 5/1964 |
| FR | 1518610 | A | 3/1968 |
| FR | 2302244 | A1 | 9/1976 |
| GB | 758817 | A | 10/1956 |
| GB | 943947 | A | 12/1963 |
| GB | 1032916 | A | 6/1966 |
| GB | 1115343 | A | 5/1968 |
| GB | 1120067 | A | 7/1968 |
| GB | 1152038 | A | 5/1969 |
| GB | 1312701 | A | 4/1973 |
| GB | 1319726 | A | 6/1973 |
| GB | 1330778 | A | 9/1973 |
| GB | 2017645 | A | 10/1979 |
| GB | 2079256 | A | 1/1982 |
| GB | 2135278 | A | 8/1984 |
| GB | 2158044 | A | 11/1985 |
| NL | 6505562 | A | 10/1966 |
| WO | 8201536 | A1 | 5/1982 |
| WO | 9408862 | A1 | 4/1994 |
| WO | 9640566 | A1 | 12/1996 |
| WO | WO9807636 | | 2/1998 |
| WO | WO0041937 | A1 | 7/2000 |
| WO | WO0075027 | A1 | 12/2000 |
| WO | 02083512 | A1 | 10/2002 |
| WO | 2006026783 | A1 | 3/2006 |
| WO | 2008063803 | A1 | 5/2008 |
| WO | 2009043038 | A1 | 4/2009 |

OTHER PUBLICATIONS

Photograph of—Blue Crate, Bottom View 1.
Photograph of—Blue Crate, Bottom View 2.
Photograph of Norseman NPL 405 Crate, Top View.
Photograph of Norseman NPL 405 Crate, Bottom View.
Photograph of Coca Cola Crate, Top View.
Photograph of Coca Cola Crate, Bottom View.
Photograph of 2L Coca Cola "Tulip" Crate, Top View.
Photograph of 2L Coca Cola "Tulip" Crate, Bottom View 1.
Photograph of 2L Coca Cola "Tulip" Crate, Bottom View 2.
Photograph of 2L Coca Cola "Tulip" Crate, Bottom View 3.

* cited by examiner

BEVERAGE CRATE

BACKGROUND

The present invention relates generally to beverage crates. A now-typical beverage crate includes a base, end walls at ends of the base, and side walls at sides of the base. The side walls each include a plurality of side columns extending upward from a lower portion of the side wall. The end walls include end columns. Corner columns are formed at corners of the crate. The columns are generally the same height and are nestable into the corresponding columns of an identical crate nested thereon when the crates are empty.

SUMMARY

A beverage crate includes a base, end walls at ends of the base, and side walls at sides of the base. The side walls each include a plurality of side columns extending upward from a lower portion of the side wall. The side walls are significantly shorter than the end walls to improve visibility and accessibility of containers in the crate. The side columns are significantly shorter than the lower portion of the side wall, significantly shorter than end columns and corner columns of the crate.

Each of the Figures is to scale.

DETAILED DESCRIPTION OF A PREFERRED EMBODIMENT

Figure 1:
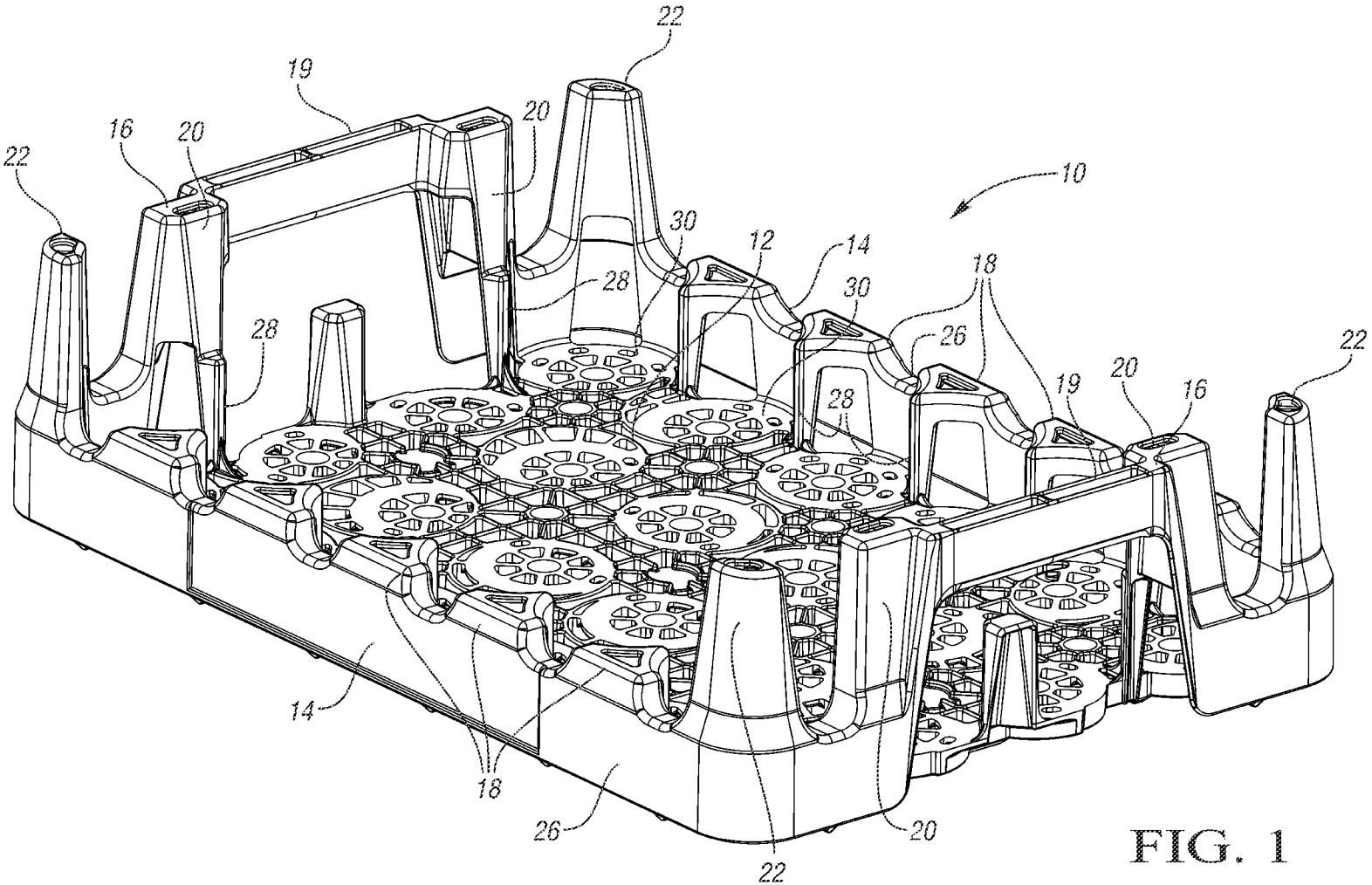
FIG. 1 is a perspective view of the crate according to one embodiment.

A crate 10 according to one embodiment is shown in FIG. 1. The crate 10 includes a base 12, side walls 14 and end walls 16. The side walls 14 may include side columns 18 extending upward from lower wall portions 26. The end walls 16 may include end columns 20. Corner columns 22 may project upward at corners of the crate 10. The side columns 18 are significantly shorter than the corner columns 22 and end columns 20, and barely protrude above the lower wall portions 26. Short windows are defined between the side columns 18. Handles 19 extend between the end columns 20.

A divider 28 projects toward an interior of the crate 10 aligned each side column 18 and end column 20. The dividers 28 partially define container-receiving areas 30 on the base 12. The example crate 10 shown is configured to accept 24 beverage bottles in a 4×6 arrangement.

Figure 2:
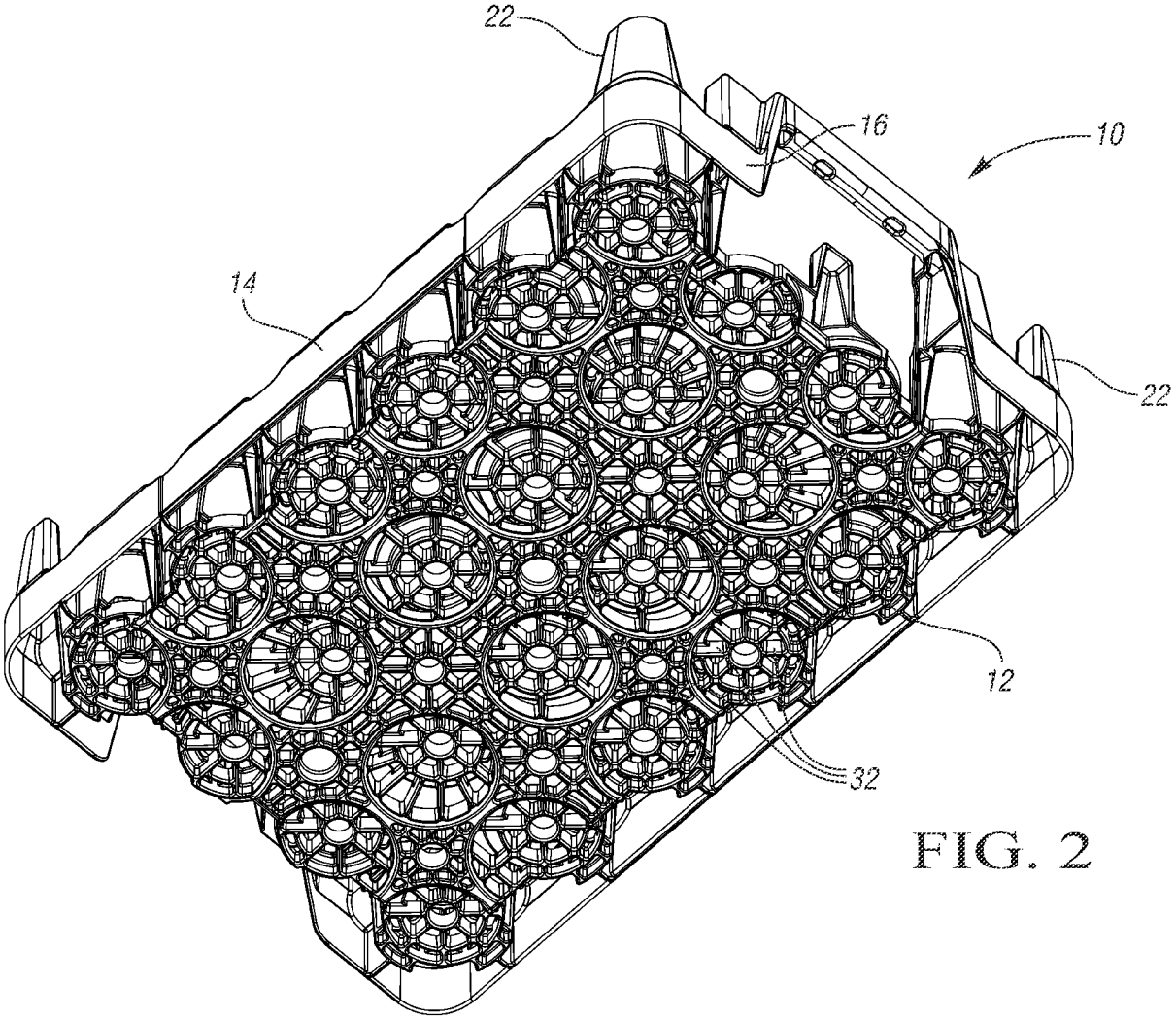
FIG. 2 is a bottom perspective view of the crate of FIG. 1.

FIG. 2 is a bottom perspective view of the crate 10. As shown, the lower surface of the base 12 includes a plurality of vertically-oriented ribs 32.

Figure 3:
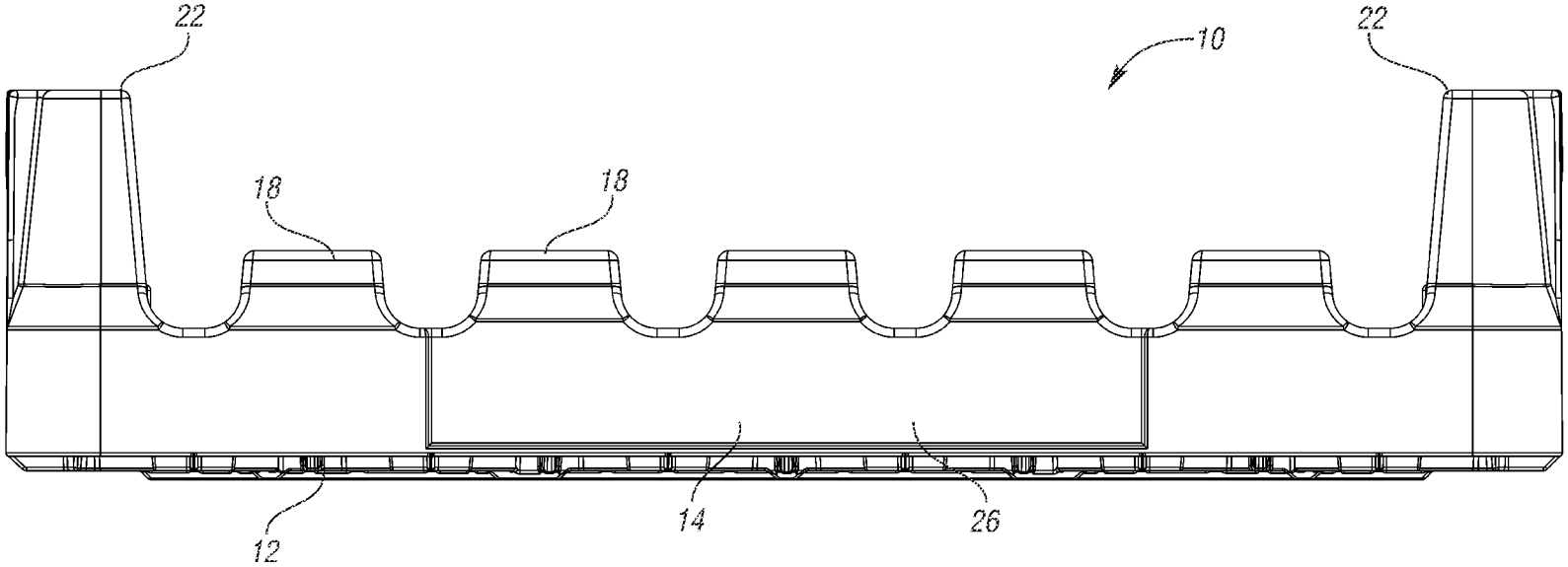
FIG. 3 is a side view of the crate of FIG. 1.
Figure 4:
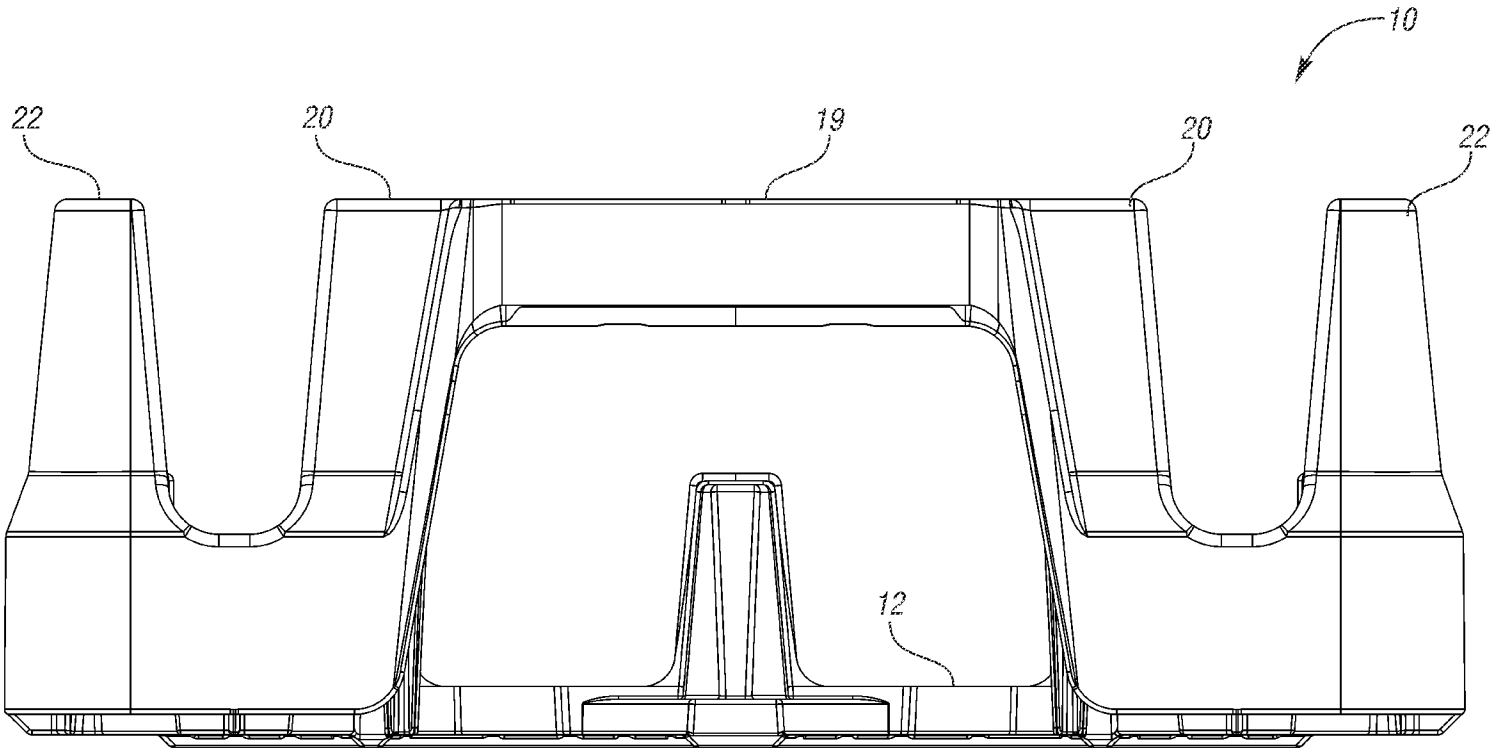
FIG. 4 is an end view of the crate of FIG. 1.

FIG. 3 is a side view of the crate 10. As shown, the side columns 18 are significantly shorter than the corner columns 22. The corner columns 22 are more than twice as tall as the side columns 18 and in this example are approximately three times as tall (as measured from the top of the lower wall portion 26 (i.e. the bottom of the windows between the side columns 18), between the side columns 18). Further, the side columns 18 (as measured from the top of the lower wall portion 26) are shorter than the lower wall portion 26 (both from the top of the lower wall portion 26 between the side columns 18 to the bottom of the lower wall portion 26 and from the top of the lower wall portion 26 between the side columns 18 to the bottom most surface of the crate 10). The lower wall portion 26 is approximately twice as tall as the side columns 18. FIG. 4 is an end view of the crate 10.

Figure 5:
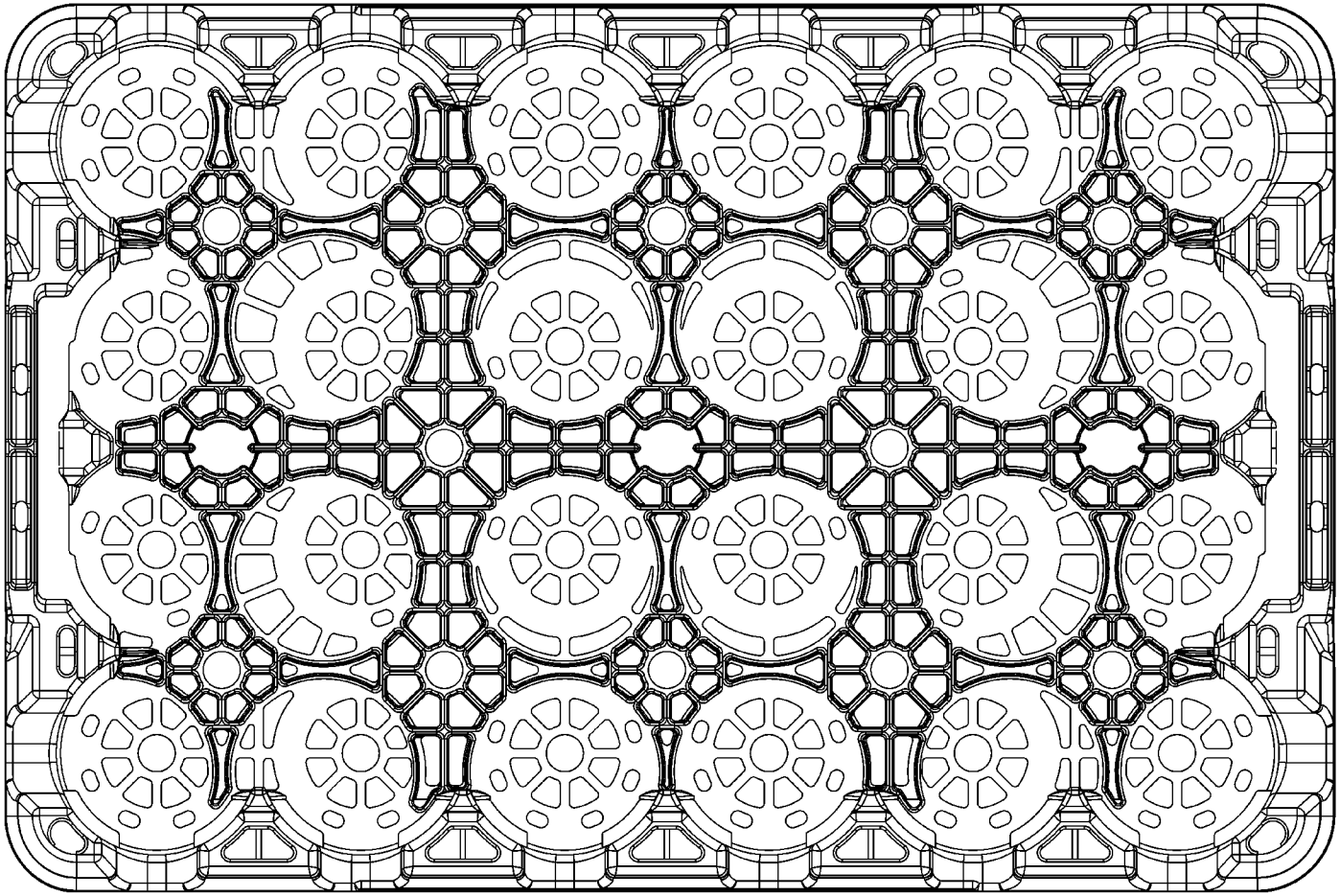
FIG. 5 is a top view of the crate of FIG. 1.
Figure 6:
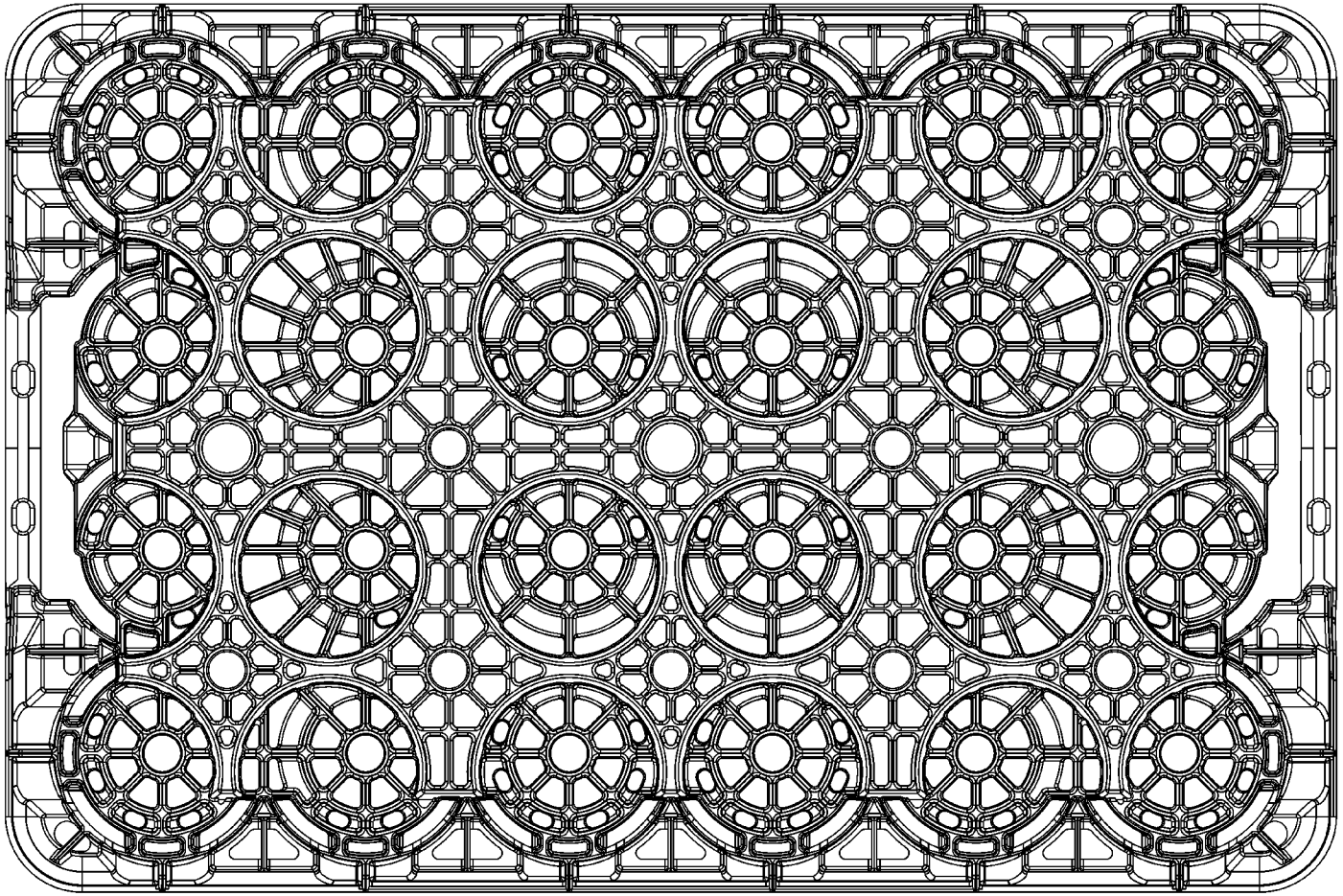
FIG. 6 is a bottom view of the crate of FIG. 1.

FIG. 5 is a top view of the crate 10. The base includes a plurality of container-receiving areas 30. FIG. 6 is a bottom view of the crate 10.

Figure 7:
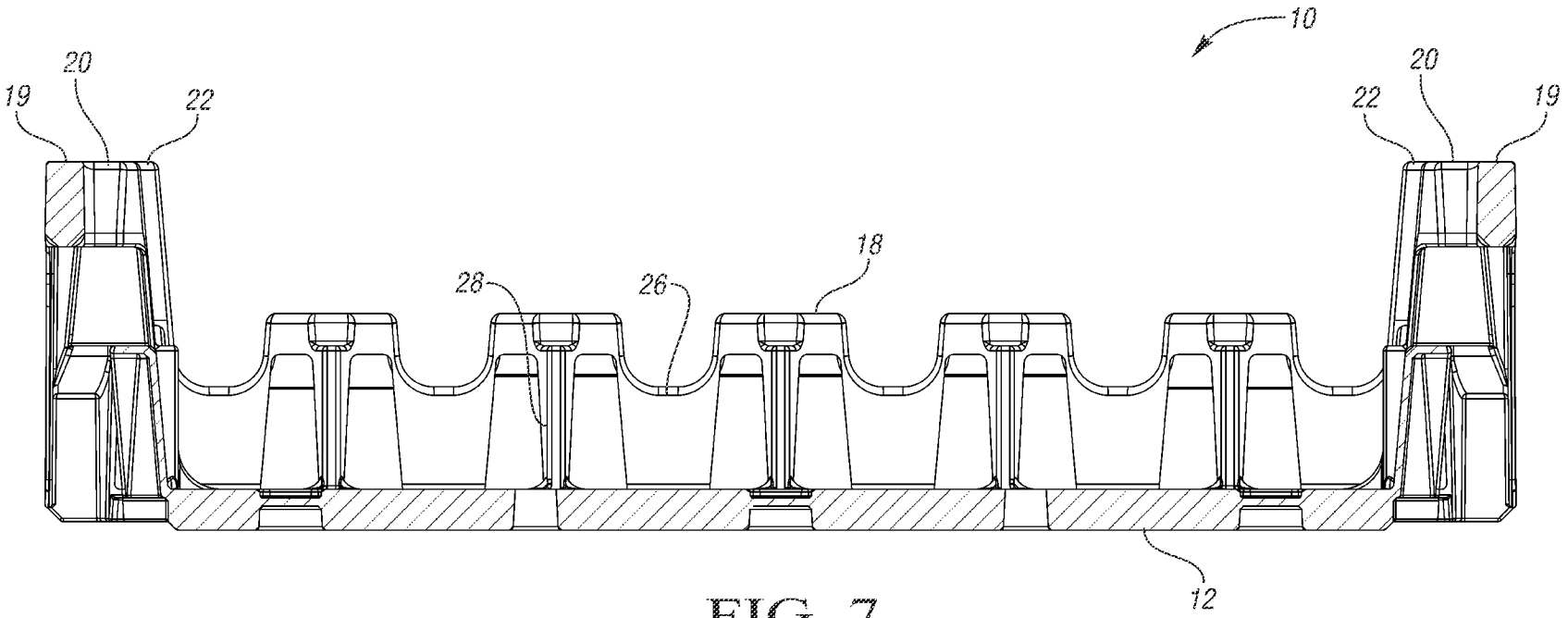
FIG. 7 is a section view of the crate of FIG. 1.

FIG. 7 is a section view taken along the longitudinal midline of the crate 10.

Figure 8:
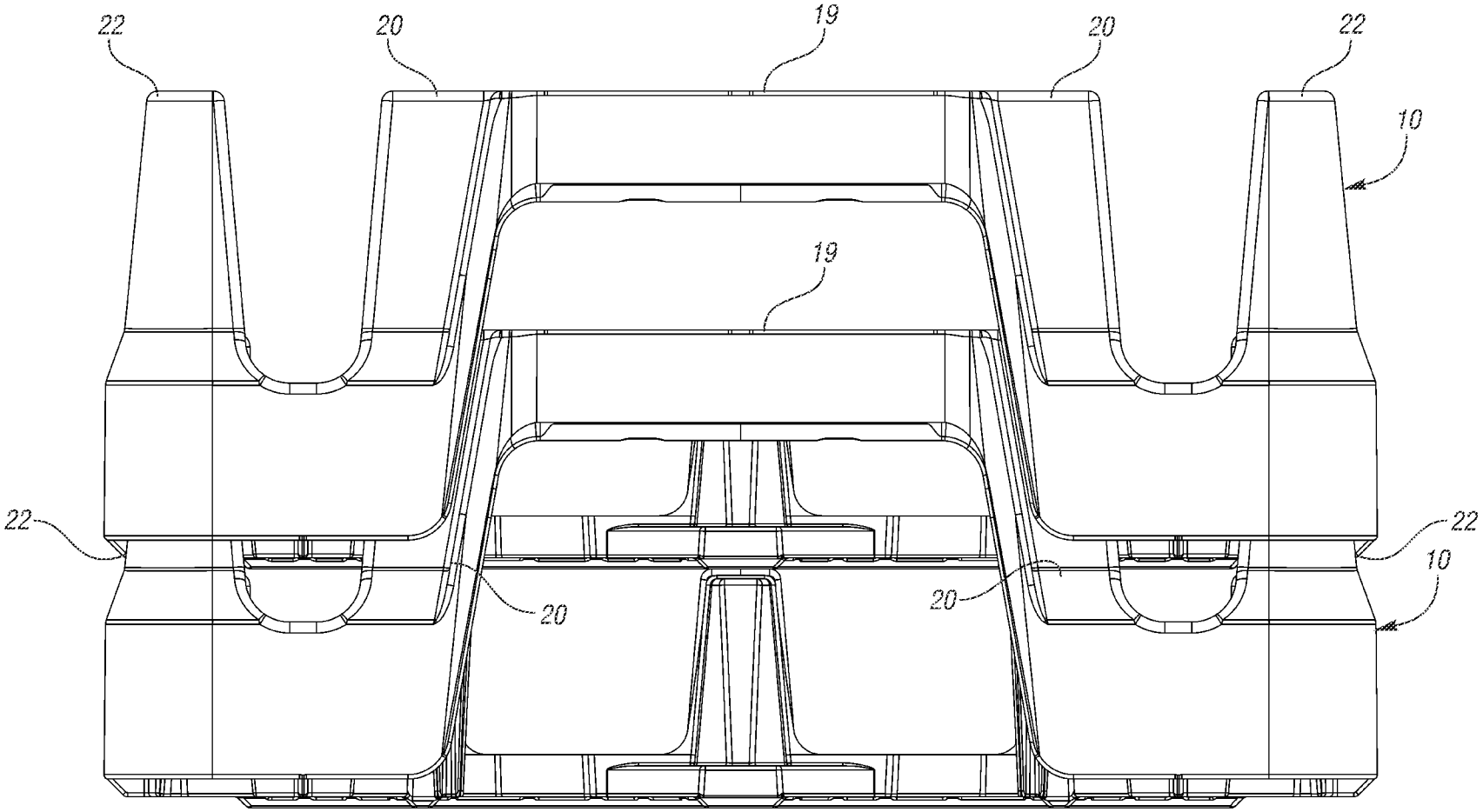
FIG. 8 is an end view of two crates of FIG. 1 stacked together.

FIG. 8 is an end view of the crate 10 with an identical crate nested thereon. As shown, the corner columns 22 of the lower crate 10 are nested within the corner columns of the upper crate 10. The end columns 20 of the lower crate 10 are nested within the end columns 20 of the upper crate 10. The handle 19 of the lower crate 10 is received between the end columns 20 of the upper crate 10.

Figure 9:
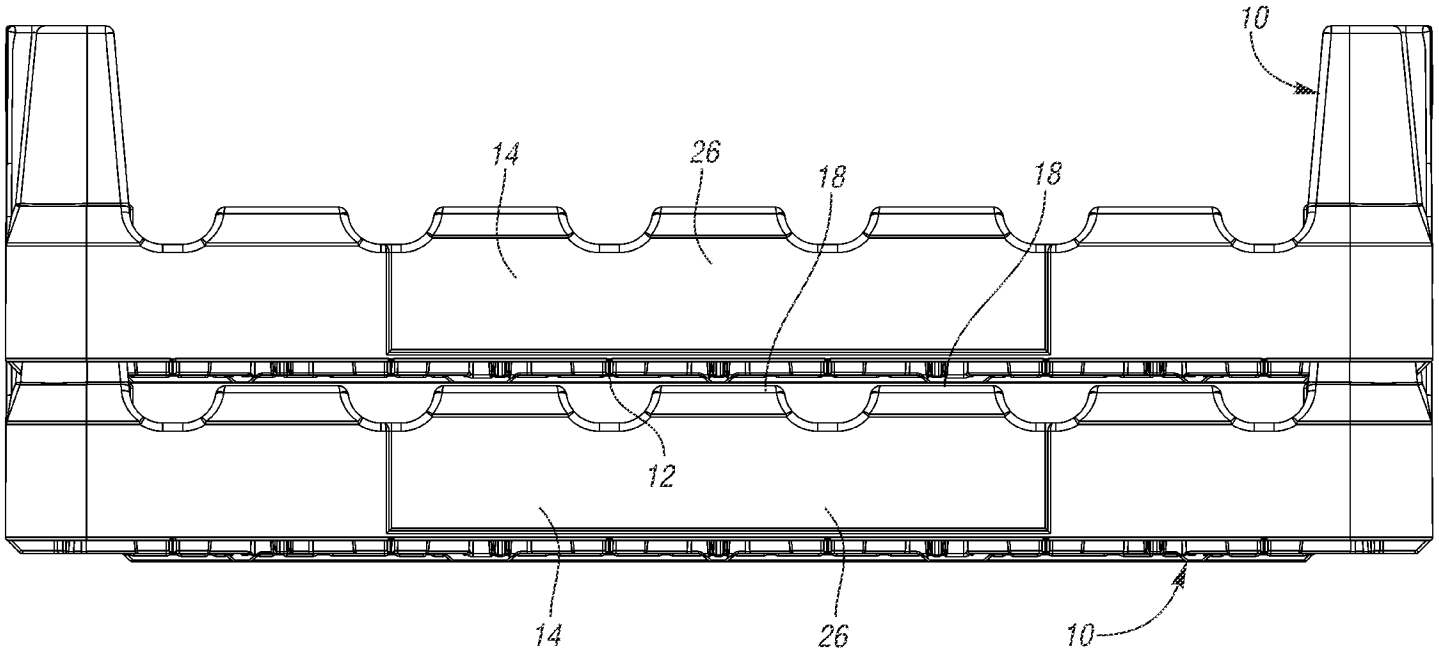
FIG. 9 is a side view of the crates of FIG. 8.

FIG. 9 is a side view of the crates 10 of FIG. 8. The side columns 18 of the lower crate 10 are lower than the lowermost surface of the base 12 of the upper crate 10, although the uppermost edges of the side columns 18 of the lower crate 10 are approximately coplanar with the lowermost surface of the base 12 of the upper crate 10.

As shown, the crate 10 is molded as a single piece of plastic. The base 12, end walls 16 and side walls 14 are all integrally molded as a single piece of suitable plastic.

In use, the example crate 10 holds 24 bottles. The short side columns 18 increase the visibility of the bottles and the removability of the bottles from the crate 10.

In accordance with the provisions of the patent statutes and jurisprudence, exemplary configurations described above are considered to represent a preferred embodiment of the invention. However, it should be noted that the invention can be practiced otherwise than as specifically illustrated and described without departing from its spirit or scope.

What is claimed is:

1. A beverage crate comprising:

a base;

end walls at ends of the base;

side walls at sides of the base, the side walls each including a plurality of side columns extending upward from a lower portion of the side wall, wherein side windows opening upward are defined between the side columns; and corner columns at corners of the crate, wherein the corner columns are more than twice as tall as the side columns, wherein the corner columns are nestable into corner columns of an identical crate nested thereon;

wherein the beverage crate is configured such that an identical crate when nested thereon would have a base the bottom surface of which would be higher than the plurality of side columns of the beverage crate.

2. The beverage crate of claim 1 wherein the corner columns are approximately three times as tall as the side columns.

3. The beverage crate of claim 1 wherein the lower portion of the side wall is approximately twice as tall as the side columns on the lower portion of the side wall.

4. The beverage crate of claim 1 wherein the end walls include end columns that are significantly taller than the side columns.

5. The beverage crate of claim 4 wherein the end columns are nestable into end columns of an identical crate nested thereon.

6. The beverage crate of claim 1 wherein the base, end walls and side walls are all integrally molded as a single piece of plastic.

7. The beverage crate of claim 1 further including a divider projecting toward an interior of the crate in alignment with each of the plurality of side columns.

8. The beverage crate of claim 1 wherein the end columns are nestable into end columns of an identical crate nested thereon.

9. The beverage crate of claim 8 wherein side windows opening upward are defined between the side columns.

10. The beverage crate of claim 9 wherein the base, end walls and side walls are all integrally molded as a single piece of plastic.

11. The beverage crate of claim 10 further including a divider projecting toward an interior of the crate in alignment with each of the plurality of side columns.

12. The beverage crate of claim 11 wherein the base has a lower surface including a plurality of vertically-oriented ribs defining bottle-cap receiving recesses.

13. The beverage crate of claim 1 wherein the base has a lower surface including a plurality of vertically-oriented ribs defining bottle-cap receiving recesses.

14. The beverage crate of claim 1 wherein the corner columns are more than twice as tall as the side columns as measured from a point at a top of the lower wall portion.

15. The beverage crate of claim 1 wherein the corner columns are more than twice as tall as the side columns as measured from a bottom of one of the side windows.

16. The beverage crate of claim 1 wherein the corner columns are more than three times as tall as the side columns as measured from a point at a top of the lower wall portion.

17. The beverage crate of claim 1 wherein the corner columns are more than three times as tall as the side columns as measured from a bottom of one of the side windows.

18. The beverage crate of claim 17 wherein the end walls each include end columns and a handle connecting the end columns, each end column including an internal rib configured such that the internal rib of the identical crate when nested on the beverage crate would contact an upper surface of the end column of the beverage crate and cause the bottom surface of the base of the identical crate to be higher than the plurality of side columns of the beverage crate.

19. A plastic beverage crate comprising:

a base;

end walls at ends of the base, wherein the end walls include end columns;

side walls at sides of the base, the side walls each including a plurality of side columns extending upward from a lower portion of the side wall to define side windows opening upward therebetween, a divider projecting toward an interior of the crate in alignment with each of the plurality of side columns, wherein the lower portion of the side wall is approximately twice as tall as the side columns on the lower portion of the side wall; and corner columns at corners of the crate wherein the corner columns are more than twice as tall as the side columns, the corner columns nestable into corner columns of an identical crate nested thereon, the end columns nestable into end columns of the identical crate when nested thereon;

wherein the beverage crate is configured such that an identical crate when nested thereon would have a base the bottom surface of which would be approximately coplanar with uppermost edges of the plurality of side columns of the beverage crate.

20. The beverage crate of claim 19 wherein the corner columns are approximately three times as tall as the side columns.

21. The beverage crate of claim 20 wherein the base, end walls and side walls are all integrally molded as a single piece of plastic.

22. The beverage crate of claim 21 wherein the end walls include end columns that are significantly taller than the side columns.

23. A plastic beverage crate comprising:

a base having a lower surface including a plurality of vertically-oriented ribs defining bottle-cap receiving recesses;

end walls at ends of the base, wherein the end walls include end columns that are nestable into end columns of an identical crate nested thereon;

side walls at sides of the base, the side walls each including a plurality of side columns extending upward from a lower portion of the side wall to define side windows opening upward therebetween, a divider projecting toward an interior of the crate in alignment with each of the plurality of side columns, wherein the lower portion of the side wall is approximately twice as tall as the side columns on the lower portion of the side wall, wherein the end columns that are significantly taller than the side columns; and corner columns at corners of the crate wherein the corner columns are more than twice as tall as the side columns, the corner columns nestable into corner columns of an identical crate nested thereon, the end columns nestable into end columns of the identical crate when nested thereon, wherein the base, end walls and side walls are all integrally molded as a single piece of plastic;

wherein the beverage crate is configured such that an identical crate when nested thereon would have a base the bottom surface of which would be approximately coplanar with uppermost edges of the plurality of side columns of the beverage crate.

* * * * *